US005369897A

United States Patent [19]

Rullier

[11] Patent Number: 5,369,897

[45] Date of Patent: Dec. 6, 1994

[54] CROSS-COUNTRY SKI BOOT

[75] Inventor: Pierre Rullier, Annecy Le Vieux, France

[73] Assignee: Salomon S.A., Chavanod, France

[21] Appl. No.: 148,535

[22] Filed: Nov. 8, 1993

Related U.S. Application Data

[63] Continuation of Ser. No. 886,199, May 21, 1992, abandoned.

[30] Foreign Application Priority Data

May 21, 1991 [FR] France ..... 91 06243

[51] Int. Cl.[5] ..... A43B 5/04; A43B 5/00

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 3,633,291 | 1/1972 | Caporicci | 36/121 |
| 4,085,528 | 4/1978 | Delery | 36/121 |
| 4,199,879 | 4/1980 | Wegeng | 36/121 |
| 4,455,769 | 6/1984 | Fritsch | 36/121 |
| 5,177,884 | 1/1993 | Rullier | 36/118 |

FOREIGN PATENT DOCUMENTS

| | | | |
|---|---|---|---|
| 0259740 | 3/1988 | European Pat. Off. | 36/117 |
| 0416437 | 3/1991 | European Pat. Off. . | |
| 2416661 | 9/1979 | France . | |
| 2638337 | 5/1990 | France . | |
| 2120242 | 11/1972 | Germany . | |
| 2635998 | 3/1977 | Germany | 36/121 |
| 2650174 | 5/1977 | Germany . | |

*Primary Examiner*—Paul T. Sewell
*Assistant Examiner*—Marie Denise Patterson
*Attorney, Agent, or Firm*—Pollock, Vande Sande & Priddy

[57] ABSTRACT

Cross-country ski boot, in particular for performance of the skating step and produced from an outer sole, on a front part of which the ski is attached, and comprising a lower upper fitted with a heel counter on which is jointed a rigid collar designed to enclose the lower part of the leg and which extends from the joint to the top of the upper beyond its upper end. The boot comprises an elastic device for the longitudinal angular control of the ski in the air in relation to the sole of the boot, during the return phase of the ski. The device may be a strap made of an elastic fabric, which connects the collar to the upper so as to cause an automatic return movement of the upper toward the collar, and, in consequence, the automatic lifting of the front part of the ski when the ski is not in a forward-propulsion phase.

9 Claims, 2 Drawing Sheets

CROSS-COUNTRY SKI BOOT

This application is a continuation of application Ser. No. 07/886,199 filed May 21, 1992, now abandoned.

FIELD OF THE INVENTION

The present invention concerns a cross-country ski boot, in particular for performance of the skating step, produced from an outer sole designed to be attached to the ski by its front part, and comprising a lower upper fitted with a heel counter to which is jointed a rigid collar designed to surround the lower part of the leg and which extends from the articulation toward the top of the upper and beyond the upper end of the latter.

BACKGROUND OF THE INVENTION

In a sport of this kind, when the skier performing the skating step finishes his propulsion motion on one of the skis, he transfers his weight onto the other, opposite ski and brings the first ski back to the level of the second.

This return movement is different depending on:

speed, thus the step used. In fact, the slower the speed the higher the frequency of the skating step, and thus the less time the skier has to pull his ski back. For this reason, the slower the speed, the less the skis are brought back into a parallel position, and the more the skier preserves a substantial divergence between the two skis.

the slope encountered. In fact, the skier must pull his ski back in the most parallel fashion possible in relation to the slope, in order not to raise the ski excessively. The inclination of the ski during the return movement thus depends on the slope encountered (a fact which makes the return movement particularly demanding and difficult on steep slopes).

These various findings have led to study of the problem of the return movement of the ski when performing the skating step.

The criteria chosen to evaluate the problem include the release of the ski, the control of the ski in the air, and the replacement of the ski on the snow.

This study revealed, in fact, that when the ski is released, the front end, or tip, of the ski tends to catche in the snow, thereby causing the real problem, namely the longitudinal angular control of the ski in the quasi-static phase, i.e., when it is in the air.

Once the problem was stated in this way, it was also found that one consequence for the skier Consisted in the need to increase the contraction of the front leg muscle so as to lift the ski and prevent the tip from catching in the snow during the return-motion phase of the ski. This is especially harmful to the skier, because he should, to the contrary, be able to use this phase to relax to the maximum extent the muscles of the leg in question, since this is supposed to be a resting, not a propulsion, phase.

SUMMARY OF THE INVENTION

The object of the present invention is to surmount these difficulties based on the problem set forth. To this end, the invention concerns a boot of the aforementioned type, which comprises elastic means for the longitudinal angular control of the ski in the air in relation to the sole of the boot, during the ski return-motion phase.

These means consist of return energy between the articulated collar and the upper, which advantageously assists the leg muscle in an effective manner during this skating phase.

As a result, the skier uses his muscles sparingly and experiences a lower level of fatigue.

Also because of these means according to the invention, the sense of the heaviness of the ski felt at the tip is appreciably attenuated. Better front-to-back position maintenance and an easier return motion of the ski are assured, and the step is begun again under better conditions, since fatigue is lessened.

BRIEF DESCRIPTION OF THE DRAWINGS

Other features and advantages of the invention will emerge during the following description, in which the invention will be described with reference to the attached drawings, in which.

DESCRIPTION OF THE INVENTION

Figure 1:
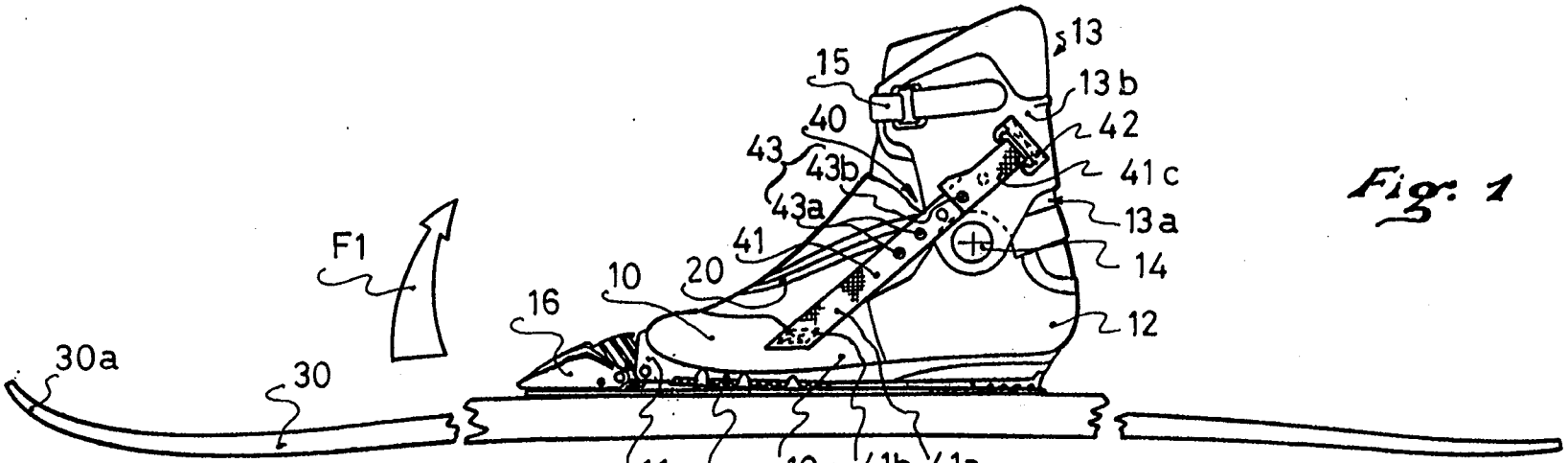
FIG. 1 is a side view of a skating boot according to the invention mounted on a ski.

The boot illustrated as an example in FIG. 1 is particularly well adapted for the skating step and has the externally appearance of a boot constituted originally by a lower upper 10, i.e., an upper whose rigid elements do not extend upward beyond the malleoli of an outer sole 11 and of a conventional closure system 20 for putting on or removing the boot, and which covers an inner lacing system.

In a conventional manner, a ski 30 is attached to a front part 11*a* of the sole 11 by means of a binding 16, illustrated schematically.

The upper 10 is made of a supple material and is fitted, at the heel, with a heel counter 12 which can be conventionally manufactured.

This counter 12 is preferably made of a rigid synthetic material and extends over the entire rear portion of the boot and completely around its heel.

In the region of the malleoli, this counter 12 extends to the top of the upper 10 to allow the attachment of a jointed collar 13 and has, at its upper extremity in the area of these malleoli, and on each side of the boot, a projection or boss (not shown) which extends outward substantially perpendicularly to the wall of the heel counter and which can be inserted into an associated cylindrical hole provided on each side of the collar, this hole receiving a nail, for example, so as to constitute a joint 14.

By means of this arrangement, the collar 13 can thus be mounted and jointed on the projecting parts of the counter 12 of the upper 10, at the upper end of the latter.

Once inserted in the nails, the nail heads act as a stop for the collar 13, while the bosses give solid form to the axis jointing this collar 13 to the upper 10.

It will be noted that the nails can be replaced by any other connection means, such as rivets, which allow rotation. However, the use of nails is especially advantageous, since it permits installation simply by exerting pressure on the heads, without requiring counter-elements, as is the case with rivets.

The jointed collar 13 is constituted by a sleeve made of a rigid material, in particular a synthetic material such as Poly (ether-block-amide) Pebax.

The collar 13 extends upward to the lower part of the calf and encloses the entire lower part of the leg. It is open in front to allow the foot to be inserted in the boot, and is also fitted with conventional tightening means 15, for example, self-gripping means.

Furthermore, collar 13 comprises an indentation 13*a* which facilitate its backward rotation.

It will be easily understood that the substantial height of the collar 13 allows excellent lateral position-maintenance of the leg while skiing, and further provides for greater distribution of reaction stresses along the leg, and, consequently, enhanced comfort for the user.

The skating boot according to the invention also comprises elastic means 40 for longitudinal angular control of the ski 30 when the ski is in the air in relation to the sole 11 of the boot during the return-motion phase of the ski, thereby making it possible to overcome specific problems encountered when performing the skating step, as described above.

In the case of FIG. 1, these means 40 are positioned between a rear area of the collar 13 belonging to the boot and a lower part of the lower upper 10 near the sole 11, and comprise two elastic devices 41 positioned symmetrically on either side of the boot along its sides, which constitute a source of energy for these control means. This energy is transmitted to the jointed collar 13 in relation to the lower part of the upper 10, in order to subject this upper to a continuous elastic stress tending to draw the upper 10 back toward the jointed collar 13 in an upward pivoting motion in the direction F1, thereby causing the automatic lifting of the front end, or tip 30*a*, of the ski 30, when the latter is not in the forward-propulsion phase.

In this instance, each elastic device 41 is constituted by a strap made of an elastic fabric, one of whose ends 41*a* is sewn on the side 10*a* of the lower part of the upper 10, at approximately the mid-point of the length of the boot, using stitches 41*b*, while the other end 41*c* runs freely through a stationary buckle 42 attached to the side 13*b* of the collar 13. After running through the buckle 42, the end 41*c* of the strap 41 is closed on itself using any fastening means, while incorporating the desired elastic tension.

In the present instance, the means for fastening the elastic strap 41 comprise a plurality of snap fasteners 43 formed, in conventional fashion, from two complementary elements, a male and a female part 43*a* and 43*b* respectively, of which the female element 43*b* is positioned near the end 41*c* of the strap 41 and cooperates with one of the male elements 43*a* positioned in alternating fashion along an intermediate area of the strap 41, so as to allow adjustable fastening incorporating the desired tension after the end 41*c* has passed through the buckle 42. The positions of the male and female elements can be reversed.

Of course, the means for fastening the elastic strap 41 can also be constituted by segments of self-gripping materials of identical length attached to the elastic strap 41, so as to allow adjustment of the strap in order to produce the desired tension. Other adjustable fastening methods can also be used.

Figure 2:
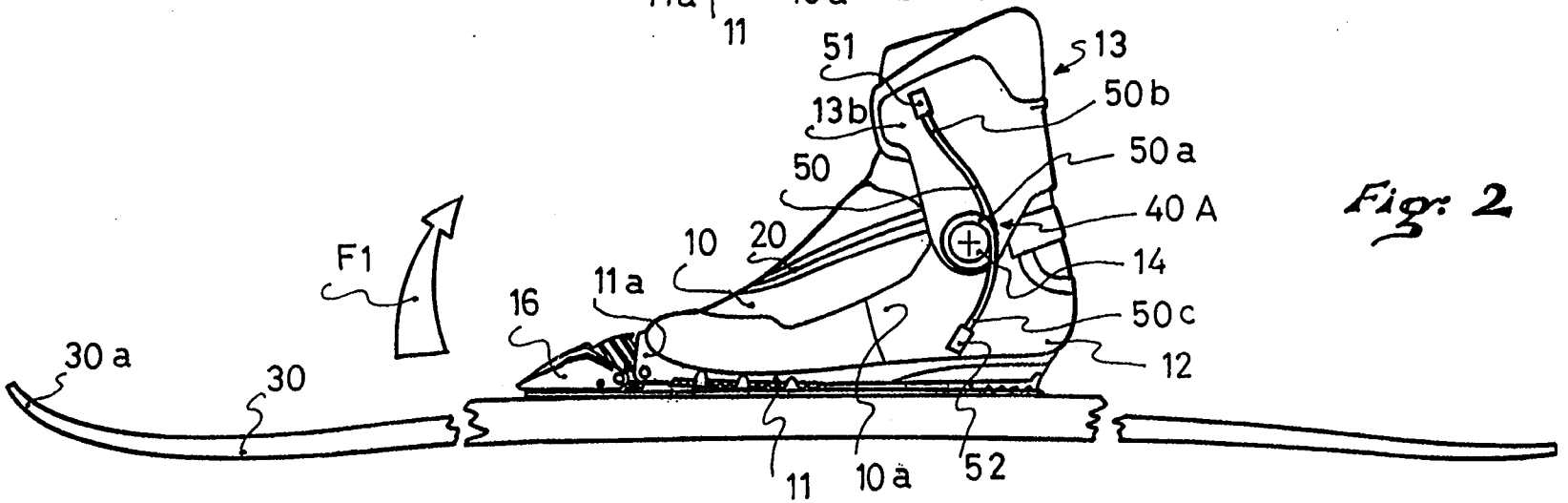
FIGS. 2, 3 and 4 are side views of different embodiments of the invention.

In the embodiment shown in FIG. 2, the elastic means 40A comprise an elastic device 50 constituted by a metal spring produced from a filiform element which creates a loop 50*a* in an intermediate area, from which extend two elastic arms 50*b*, 50*c* inserted under tension behind two stationary position-maintenance stops 51, 52, these stops being positioned respectively on at least one side 13*b* of the collar 13 and on at least one side 10*a* of the upper 10 located to the rear of the latter. In this way, the elastic device 50 is continuously prestressed and tends to draw the upper 10 back toward the collar 13 in the direction F1, thereby helping, as in the preceding example, to lift the tip 30*a* of the ski 30 during the return phase.

Figure 3:
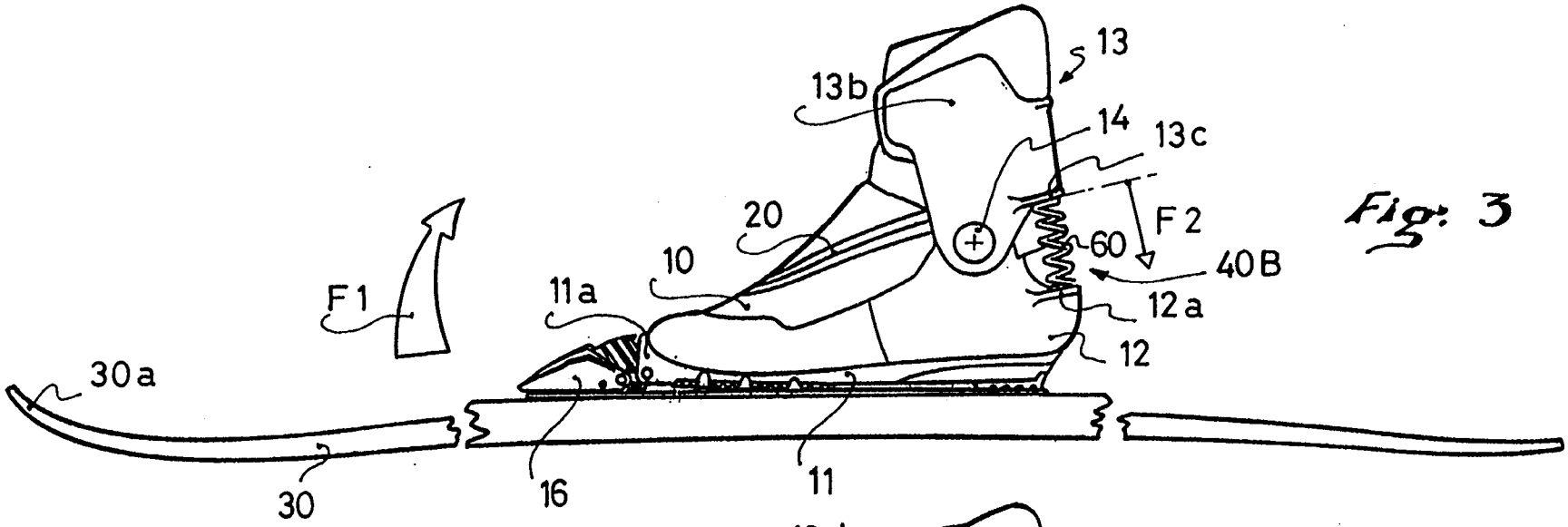

In the embodiment illustrated in FIG. 3, the elastic means 40B comprise a metal spring 60 functioning under compression and positioned between a stop 12*a* provided on a rear portion of the heel counter 12 of the upper 10 and a stop 13*c* provided in the corresponding position on the collar 13. In this configuration, the spring 60 acts under compression on the rear part of the upper 10 in the direction F2, this force causing the tip 30*a* to be lifted in the desired direction F1.

Figure 4:
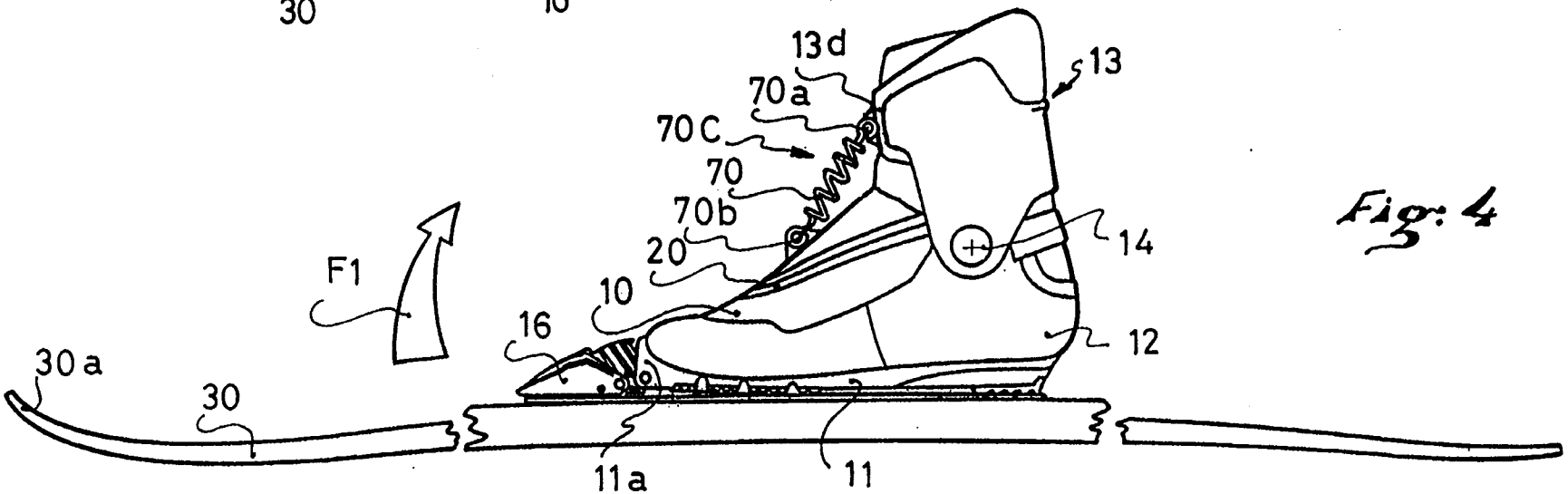

In the embodiment illustrated in FIG. 4, the elastic means 40C comprise a metal spring 70 acting under traction between a point 70*a* on a front part 13*d* of the collar 13 and a point 70*b* on a front upper part of the upper 10.

In this configuration, the spring 70 acts under traction on the upper 10 by tending to bring the upper 10 closer to the collar 13, and this force causes the tip 30*a* to be raised in the desired direction F1.

I claim:

1. Cross-country ski boot, in particular for the performance of the skating step, said boot comprising (a) an outer sole 11) comprising means for fixing of a front portion (11*a*) of said outer sole to a ski having a forward tip portion, a rear part of the boot being freely movable relative to said ski;

(b) an upper (10) made of a supple material and fitted with a heel counter (12);

(c) a rigid collar (13) articulated on said heel counter (12) of said upper, and surrounding a lower part of a leg of a skier; and (d) elastic means arranged between said collar and said upper, said elastic means biasing said upper toward said collar and thereby causing said forward tip portion of a said ski when fixed to said boot to be raised toward said collar, for longitudinal angular control of said ski in air.

2. Boot according to claim 1, wherein said elastic device (41) is constituted by a strap made of an elastic fabric, a first end (41*a*) of said strap being attached to at least one side (10*a*) of said lower upper (10) in proximity to said collar (13), and a second end (41*c*) of said strap being free to pass through a stationary buckle (42) on at least one side (13*b*) of said collar (13) and to be closed on itself using fastening means.

3. Boot according to claim 2, wherein said fastening means are constituted by segments of self-gripping materials added to said elastic strap (41) in a determinate length, thereby permitting adjustment to a desired tension.

4. Boot according to claim 2, wherein the means for fastening said elastic strap (41) comprise at least one snap fastener (43) composed of complementary male and female elements (43*a*, 43*b*), one of said elements being positioned adjacent to said second end (41*c*) of said strap (41) and cooperating under pressure with the other element, which is positioned in an intermediate zone of said strap (41) after having exerted a desired tension on said strap (41) after it has passed through said buckle (42).

5. Boot according to claim 4, wherein the part of said snap fastener (43) located adjacent to said end (41*c*) of said strap (41) is female, respectively male, and cooperates under pressure with a plurality of male, respectively female elements, positioned in alternating fashion along said strap (41) so as to permit adjustment to a desired tension.

6. Boot according to claim 1, wherein said elastic device (50) is constituted by a metal spring produced from a filiform element forming a buckle (50*a*) in an intermediate area and from which extend two elastic arms (50, 50*c*) engaged under tension behind two stationary position-retention stops (51, 52) positioned respectively on at least one side (13*b*) of said collar (13) and on at least one side (10*a*) of a rear part of said upper (10).

7. Boot according to claim 1, wherein said elastic means (70) is constituted by a metal spring which acts under traction between a point (70*a*) positioned on a front part (13*d*) of said collar (13) and a point (70*b*) positioned on a front upper part of said upper (10).

8. Boot according to claim 1, wherein said elastic means (60) is constituted by a metal spring which acts under compression and is positioned between a stop (12*a*) provided on a rear part of said upper (10) in the area of said heel counter (12) and a stop (13*c*) provided in the corresponding position on said collar (13).

9. Boot according to claim 2, wherein said elastic devices (41, 50) are positioned on each of the lateral sides of said boot.

* * * * *